US011634249B2

(12) United States Patent
Khairkhah Masooleh et al.

(10) Patent No.: US 11,634,249 B2
(45) Date of Patent: Apr. 25, 2023

(54) SLIDE-OPEN DISPENSER PACKAGE FOR LOOSE ARTICLES

(71) Applicant: G.D S.P.A., Bologna (IT)

(72) Inventors: Farzin Khairkhah Masooleh, Fermignano (IT); Alessandro Faggi, Pesaro (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 125 days.

(21) Appl. No.: 16/771,493

(22) PCT Filed: Dec. 10, 2018

(86) PCT No.: PCT/IB2018/059822
§ 371 (c)(1),
(2) Date: Jun. 10, 2020

(87) PCT Pub. No.: WO2019/116194
PCT Pub. Date: Jun. 20, 2019

(65) Prior Publication Data

US 2021/0122520 A1 Apr. 29, 2021

(30) Foreign Application Priority Data

Dec. 12, 2017 (IT) ..... 102017000142761

(51) Int. Cl.
*B65D 5/72* (2006.01)
*B65D 83/04* (2006.01)

(52) U.S. Cl.
CPC ..... *B65D 5/728* (2013.01); *B65D 5/724* (2013.01); *B65D 83/0409* (2013.01); *B65D 2583/0468* (2013.01); *B65D 2583/0481* (2013.01)

(58) Field of Classification Search
CPC ..... B65D 5/724; B65D 83/00; B65D 83/04; B65D 83/0409; B65D 2583/0468; B65D 2583/0481
See application file for complete search history.

(56) References Cited

U.S. PATENT DOCUMENTS 1,566,445 A * 12/1925 Stringer ..... B65D 5/724 221/260
1,889,232 A * 11/1932 Ware ..... B65D 5/724 221/64

(Continued)

FOREIGN PATENT DOCUMENTS

DE 202012103697 U1 10/2012
EP 1888414 A1 2/2008

(Continued)

OTHER PUBLICATIONS

International Search Report and Written Opinion dated Feb. 20, 2019 from counterpart PCT App No. PCT/IB2018/059822.

*Primary Examiner* — Gene O Crawford
*Assistant Examiner* — Kelvin L Randall, Jr.
(74) *Attorney, Agent, or Firm* — Shuttleworth & Ingersoll, PLC; Timothy J. Klima

(57) ABSTRACT

A slide-open dispenser package for loose articles including: a container for containing a plurality of loose articles, in which the container includes a bottom wall and an article dispensing outlet opening made in the bottom wall; a wrapper on the outside of the container and slidably coupled thereto along a sliding direction orthogonal to the bottom wall; at least one occluding element for occluding the outlet opening, in which the occluding element is movable between a closed configuration, in which it prevents the articles from coming out of the opening, and an open configuration, in which it allows at least one article to come out through the outlet opening. The occluding element is (Continued)

fixed to the container and to the wrapper so that the reciprocal sliding of the wrapper and the container causes the occluding element to move between the closed configuration and the open configuration.

17 Claims, 11 Drawing Sheets

(56) References Cited

U.S. PATENT DOCUMENTS

| | | | | | |
|---|---|---|---|---|---|
| 3,186,591 | A | | 6/1965 | Benjamin et al. | |
| 3,246,800 | A | | 4/1966 | Stone et al. | |
| 3,392,878 | A | | 7/1968 | Jackson et al. | |
| 3,977,520 | A | * | 8/1976 | Grimm | B65D 85/1054 206/270 |
| 4,230,236 | A | * | 10/1980 | Boulter | B65D 83/0409 221/190 |
| 4,240,548 | A | * | 12/1980 | Stio | B65D 85/1009 206/250 |
| 4,418,838 | A | * | 12/1983 | Gallina | B65D 83/0409 221/246 |
| 4,653,668 | A | * | 3/1987 | Gibilisco | B65D 83/0409 206/540 |
| 4,967,909 | A | * | 11/1990 | McKibben | B65D 5/725 206/555 |
| 5,174,471 | A | | 12/1992 | Kozlowski et al. | |
| 11,147,741 | B2 | * | 10/2021 | Brouard | B65D 83/0409 |
| 2010/0006589 | A1 | * | 1/2010 | Klein | B65D 83/0409 221/282 |
| 2010/0258583 | A1 | * | 10/2010 | Schick | B65D 83/0409 221/279 |
| 2011/0011883 | A1 | * | 1/2011 | Nakkouri | B65D 83/0409 221/206 |
| 2013/0306669 | A1 | * | 11/2013 | Ray | A47K 10/421 221/63 |
| 2015/0060534 | A1 | | 3/2015 | Domit | |
| 2015/0342830 | A1 | * | 12/2015 | Bujalski | A61J 7/0076 221/1 |
| 2020/0039729 | A1 | * | 2/2020 | Martin | B65D 83/0409 |

FOREIGN PATENT DOCUMENTS

| | | | |
|---|---|---|---|
| EP | 2368806 | A1 | 9/2011 |
| WO | 2015168045 | A1 | 11/2015 |

* cited by examiner

X

SLIDE-OPEN DISPENSER PACKAGE FOR LOOSE ARTICLES

TECHNICAL FIELD

This invention addresses the technical sector of packages for loose articles, in particular for articles which are spherical, oval or cylindrical in shape. More in detail, this invention addresses the technical sector of slide-open, sleeved, packages for loose confectionery articles such as, for example, dragées, candies or chocolates.

BACKGROUND ART

Known from document WO2015/168045 is a sleeved package for confectionery products. The package consists of a box, which contains the loose articles and which comprises a lateral wall with a hole made in it for dispensing the articles from the box, and a sleeve-like wrapper placed round the outside of the box.

The box can slide relative to the wrapper between a closed position in which the wrapper covers the hole in the box and the articles are prevented from coming out of the box, and an open position in which the articles are able to come out of the box.

Once the box is in the open position, the user must move it repeatedly, turning it through an angle between 90° and 180° each time, to cause an article to come out. This repeated movement, however, can cause two or more articles to come out at the same time, uncontrollably and against the user's wishes. The repeated movement might also damage the articles (for example, candies or dragées).

DISCLOSURE OF THE INVENTION

The aim of this invention, therefore, is to provide a slide-open dispenser package to overcome the above mentioned disadvantages.

This aim is achieved by a slide-open dispenser package for loose articles according to the accompanying claims.

The proposed package, considering the position of the outlet opening relative to the reciprocal movement of the container and the wrapper, allows dispensing one article while holding the package with its bottom wall substantially horizontal. In other words, the reciprocal movement of the container and the wrapper automatically causes the article to be dispensed.

Furthermore, the fact that the occluding element is moved by the reciprocal movement of the wrapper and the container makes it possible to conveniently and easily control the number of articles to be dispensed from the container.

BRIEF DESCRIPTION OF THE DRAWINGS

The invention is described below with reference to the accompanying drawings, which illustrate a non-limiting embodiment of it and in which.

DETAILED DESCRIPTION OF PREFERRED EMBODIMENTS OF THE INVENTION

Figure 2:
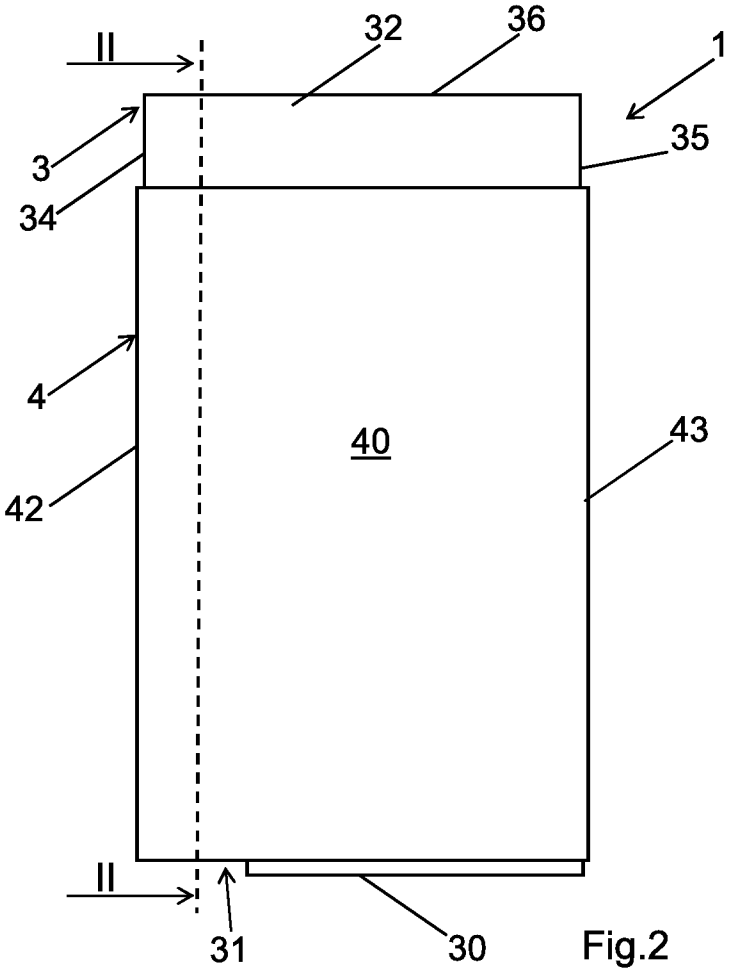
FIGS. 1 and 2 are front views of a first embodiment of the package of this invention in respective operating steps.

With reference to the accompanying drawings, the numeral 1 generically denotes a slide-open dispenser package for loose articles according to this invention.

The term "loose articles" is used to mean a plurality of articles 2 which are not connected to one another. In particular, the proposed package 1 is particularly advantageous with articles 2 having a spherical, oval or cylindrical shape. For example, the articles 2 may be confectionery articles 2 such as candies, dragées, pralines or chocolates.

Described below with reference to FIGS. 1, 2 and 3A-3C is a first embodiment of the package 1 of this invention.

According to this first embodiment, the package 1 comprises: a container 3 for containing a plurality of loose articles 2, in which the container 3 comprises a bottom wall 30 and an article dispensing outlet opening 31 for taking the articles out of the container 3; a wrapper 4 disposed externally of the container 3.

The wrapper 4 and the container 3 are slidably coupled to each other and reciprocally movable along a sliding direction X orthogonal to the bottom wall 30 of the container 3.

The outlet opening 31 is made in the bottom wall 30 of the container 3.

Figure 3C:
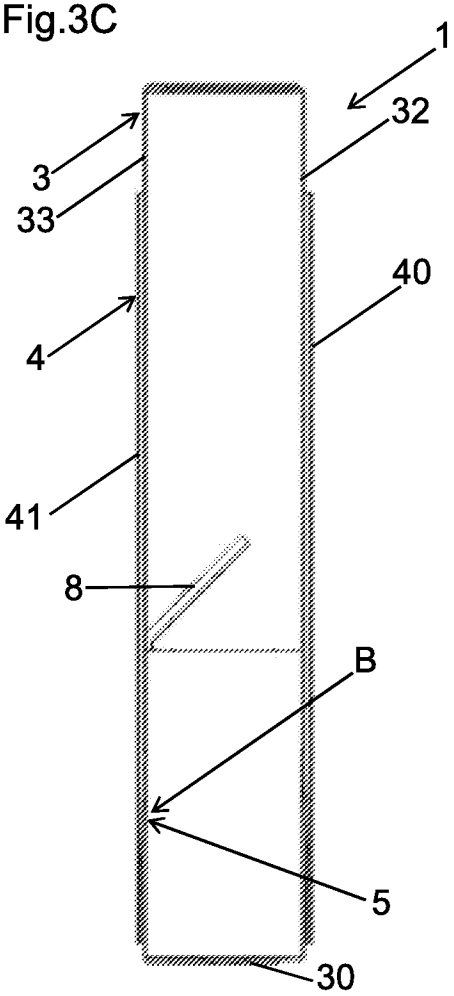
FIGS. 3A and 3C are cross section views along sections I-I and II-II of FIG. 1 and FIG. 2, respectively.
Figure 3B:
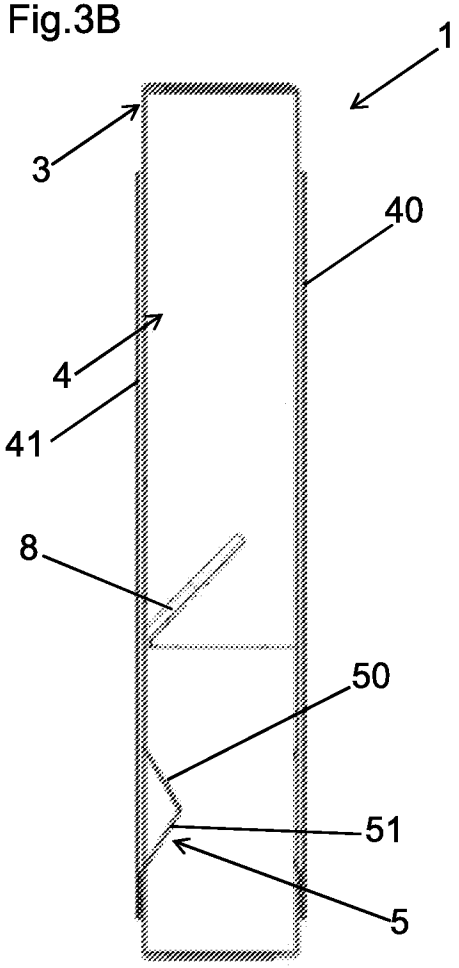
FIG. 3B is a view similar to those of FIGS. 3A and 3C in an intermediate operating step.
Figure 3A:
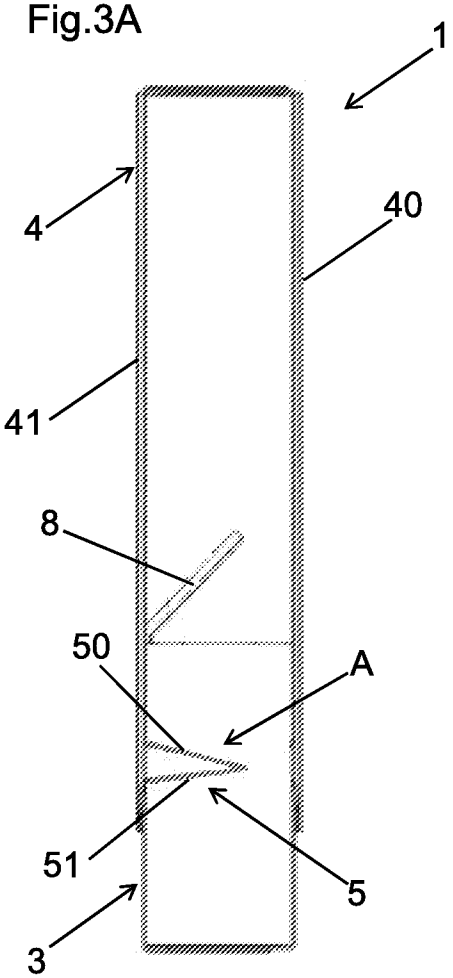
Figure 5:
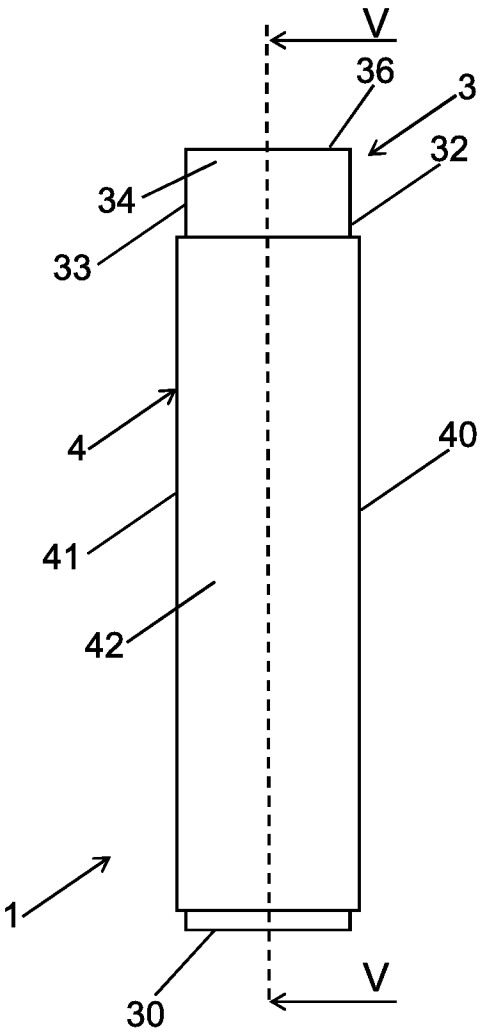
FIG. 5 is a side view of the package of FIG. 4.
Figure 4:
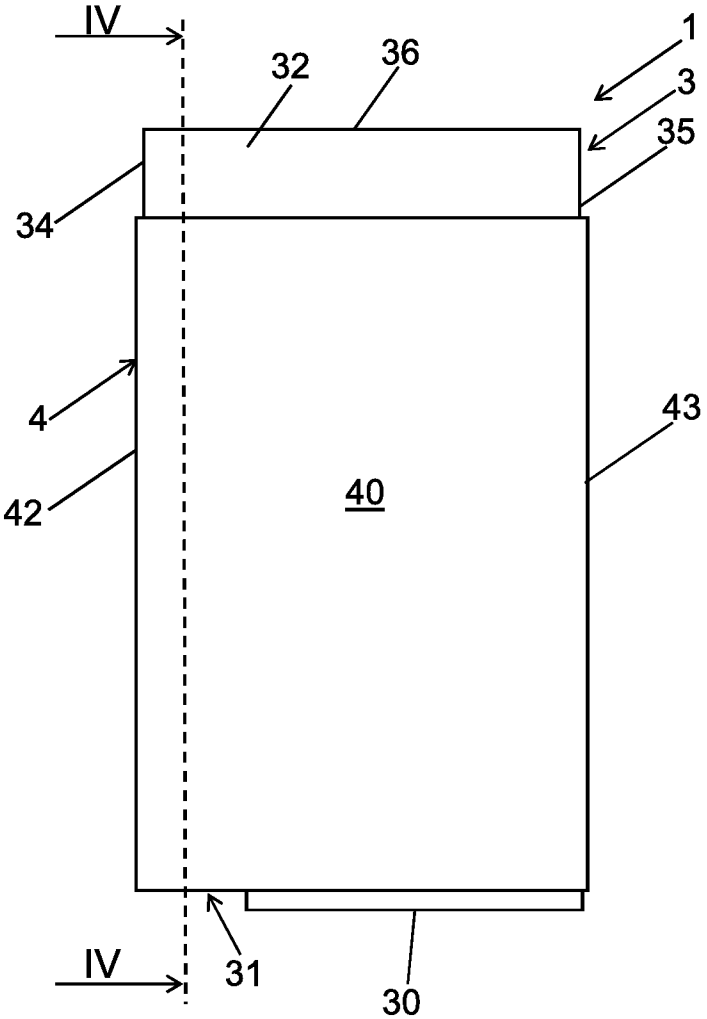
FIGS. 4 and 6-8 are front views of a further embodiment of the package of this invention in respective operating steps.
Figure 8:
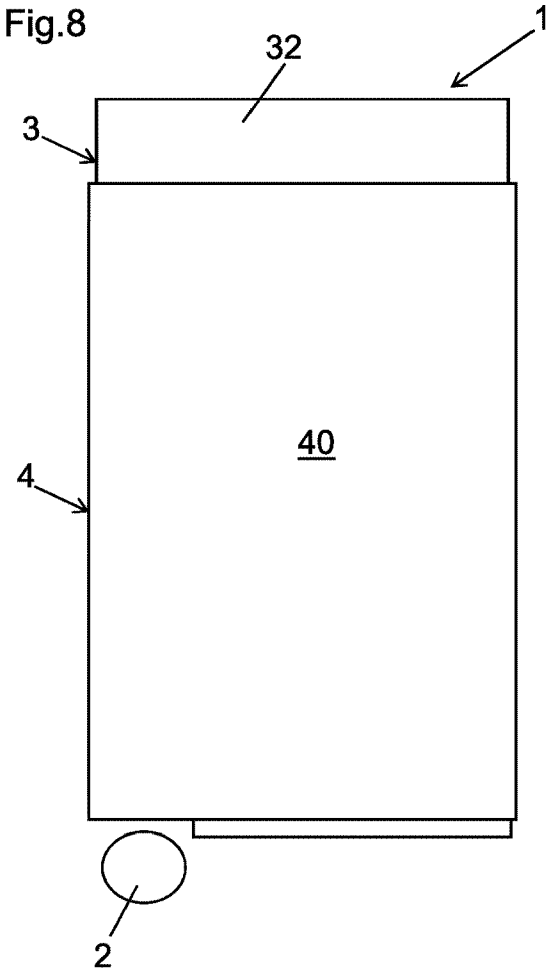
Figure 7:
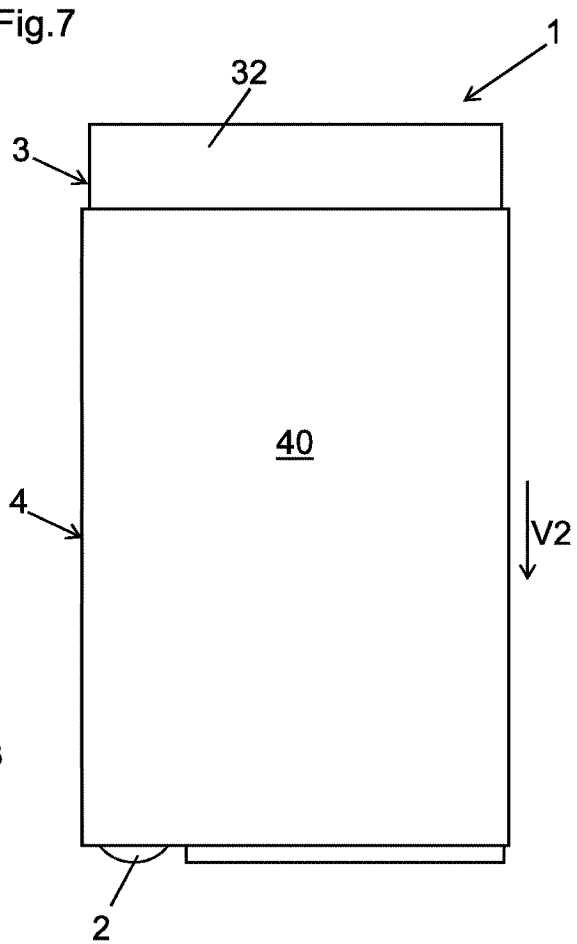
Figure 6:
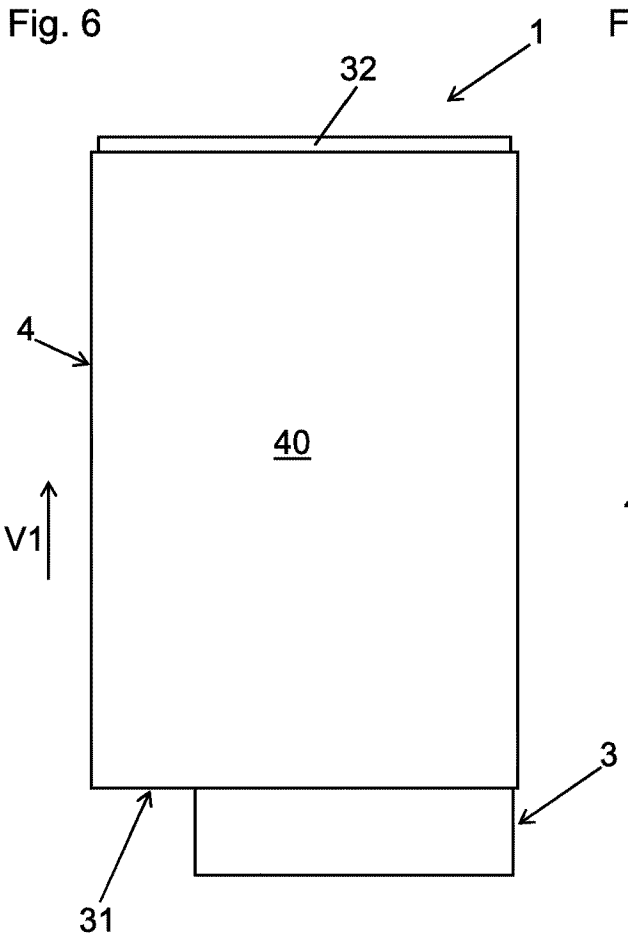

The package 1 also comprises an occluding element 5 for occluding the outlet opening 31 (FIGS. 3A-3C). The occluding element 5 is movable between a closed configuration A (FIGS. 1 and 3A), in which it prevents the articles 2 from coming out of the opening 31, and an open configuration B (FIGS. 2 and 3C), in which it allows at least one article 2 to come out through the outlet opening 31.

The occluding element 5 is fixed to the container 3 and to the wrapper 4 so that the reciprocal sliding of the wrapper 4 and the container 3 causes the occluding element 5 to move between the closed configuration A and the open configuration B.

Advantageously, the package 1 allows the articles 2 to be dispensed from the container 3 with the package 1 held in a substantially vertical position, that is, with the bottom wall 30 substantially horizontal. In other words, the reciprocal movement of the container 3 and the wrapper 4 automatically causes the article 2 to be dispensed. Furthermore, the package 1 advantageously makes it possible to conveniently and easily control the number of articles 2 to be dispensed from the container 3: for this purpose, it is sufficient to reciprocally move the wrapper 4 and the container 3 along the sliding direction X.

As illustrated schematically, the occluding element 5 comprises: a first tab 50 having a first end fixed to the container 3 and a second end; a second tab 51 having a first end hinged to the second end of the first tab 50 and a second end fixed to the wrapper 4.

Advantageously, this structure makes it easy for the occluding element 5 to move between the closed configuration A and the open configuration B.

With reference to FIG. 3A, when the occluding element 5 is in the closed configuration A, the first tab 50 and the second tab 51 face each other to form an element whose transverse cross section is triangular and which protrudes towards the inside of the container 3. With reference to FIG. 3C, on the other hand, when the occluding element 5 is in the open configuration B, the first tab 50 and the second tab 51 are substantially aligned (aligned vertically, that is, substantially parallel to the sliding direction X). FIG. 3B shows an intermediate step in which the occluding element 5 is between the closed configuration A and the open configuration B.

In the embodiment illustrated, the occluding element 5 is made as a single part with the container 3 and is fixed to the wrapper 4 by gluing. It is understood that it might also be made as a single part with the wrapper 4 and be fixed to the container 3. As a further alternative, the occluding element 5 might be made as a separate element and be fixed (for example by gluing) to the container 3 and to the wrapper 4.

With further reference to FIGS. 1, 2, 3A-3C, the user can dispense an article 2 from the container 3 by resting the bottom wall 30 of the container 3 on the palm of the hand, for example, and sliding the wrapper 4 relative to the container 3 in such a way that the occluding element 5 moves from the closed configuration A to the open configuration B. Once the desired number of articles 2 have been dispensed, the user can slide the wrapper 4 relative to the container 3 again so as to move the occluding element 5 back to the closed configuration A.

Figure 1:
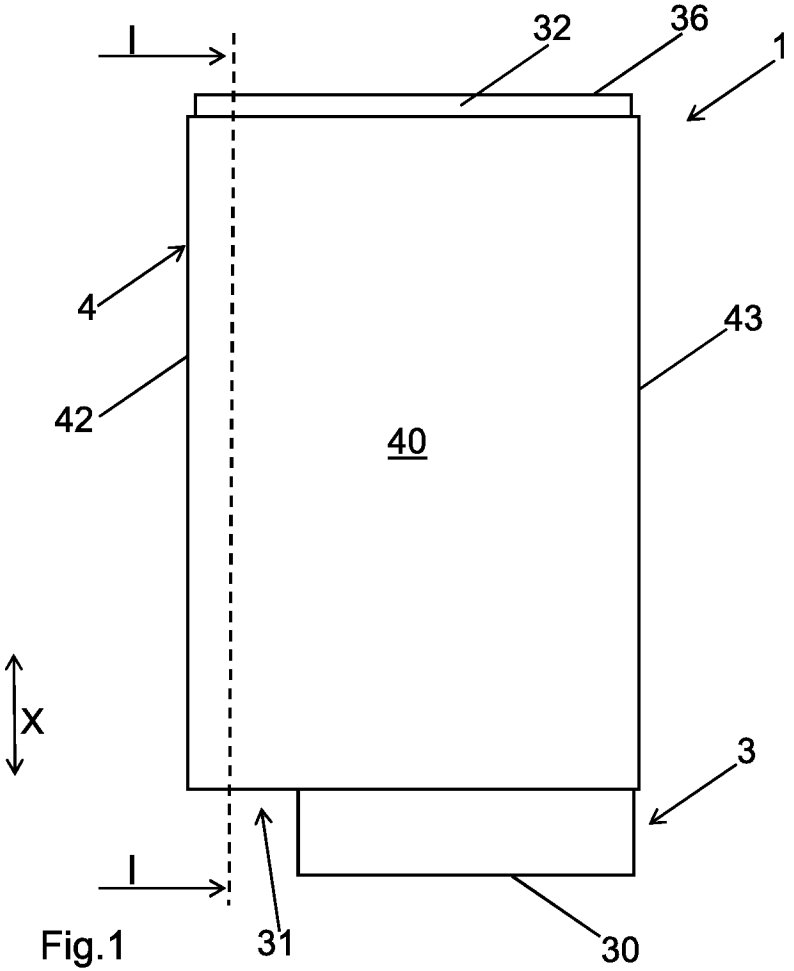

The container 3 is substantially in the shape of a parallelepiped. With reference to FIGS. 1 and 2, the container 3 comprises: a first lateral wall 32 and a second lateral wall 33 which extend upwards from the bottom wall 30 and which are opposed and parallel to each other; a first flank 34 and a second flank 35 which extend upwards from the bottom wall 30, connecting the first lateral wall 32 to the second lateral wall 33, and which are opposed and parallel to each other; a top wall 36 which is opposed and parallel to the bottom wall 30.

Besides the bottom wall 30, the outlet opening 31, also affects the first lateral wall 32, the second lateral wall 33 and the first flank 34. In other words, the outlet opening 31 is in the form of an aperture cut out from the bottom wall 30, the first lateral wall 32, the second lateral wall 33 and the first flank 34. Thus, the first lateral wall 32 and the second lateral wall 33 are rectangular in shape, with an aperture (material cut out preferably rectangular in shape) at the corner which they have in common with the bottom wall 30 and the first flank 34. It is noted that the first flank 34 is not connected to the bottom wall 30. Also, in the sliding direction X, the first flank 34 is shorter in length than the second flank 35.

The wrapper 4 is sleeve-like in form. More specifically, the wrapper 4 may comprise a first wall 40 and a second wall 41 which are opposed and parallel to each other, and a first flank 42 and a second flank 43 which connect the first wall 40 to the second wall 41 and which are opposed and parallel to each other.

More in detail, the first wall 40 of the wrapper 4 is opposed to the first lateral wall 32 of the container 3, the second wall 41 of the wrapper 4 is opposed to the second lateral wall 33 of the container 3, the first flank 42 of the wrapper 4 is opposed to the first flank 34 of the container 3 and the second flank 43 of the wrapper 4 is opposed to the second flank 35 of the container 3.

The occluding element 5 is fixed to the second lateral wall 33 of the container 3 and to the second wall 41 of the wrapper 4. Alternatively, the occluding element 5 might be fixed to the first lateral wall 32 of the container 3 and to the first wall 40 of the wrapper 4.

The container 3 and the wrapper 4 may be made of paperboard, for example from two distinct blanks.

With further reference to FIGS. 3A-3C, the package 1 comprises a conveying plane 8 for conveying the articles 2, which is disposed inside the container 3 and which is inclined to the bottom wall 30 of the container 3 to facilitate conveying the articles 2 towards the outlet opening 31 of the container 3.

Advantageously, the conveying plane 8 allows the articles 2 to be fed continuously towards the outlet opening 31.

Described below with reference to FIGS. 4-12 is a further embodiment of the package 1 of this invention.

This further embodiment includes the features already described with reference to the first embodiment (FIGS. 1, 2, 3A-3C).

In this second embodiment, the package 1 comprises a pair of occluding elements 5 for occluding the outlet opening 31, the pair of occluding elements 5 being movable between a closed configuration A (FIGS. 6, 9C, 10C), in which they prevent the articles 2 from coming out through the outlet opening 31, and an open configuration B (FIGS. 4, 9A, 10A, 9E, 10E), in which they allow at least one article 2 to come out through the outlet opening 31.

More in detail, each occluding element 5 is fixed to the container 3 and to the wrapper 4 so that the mutually sliding of the wrapper 4 and the container (3) causes the pair of occluding elements 5 to move between the closed configuration A and the open configuration B.

Advantageously, similarly to what is described above for the first embodiment, the package 1 allows the articles 2 to be dispensed from the container 3 with the package 1 held in a substantially vertical position, that is, with the bottom wall 30 substantially horizontal. In other words, the reciprocal movement of the container 3 and the wrapper 4 automatically causes the article 2 to be dispensed. Furthermore, the package 1 advantageously makes it possible to conveniently and easily control the number of articles 2 to be dispensed from the container 3: for this purpose, it is sufficient to reciprocally move the wrapper 4 and the container 3 along the sliding direction X.

More in detail, the occluding elements 5 of the pair are fixed one to the first lateral wall 32 of the container 3 and to the first wall 40 of the wrapper 4 and the other to the second lateral wall 33 of the container 3 and to the second wall 41 of the wrapper 4. Thus, the occluding elements 5 of the pair are opposed to each other.

The use of a pair of occluding elements 5 (instead of a single occluding element 5) advantageously allows sizing the package 1 because it is sufficient to move the container 3 and the wrapper 4 for a shorter distance to open and close the outlet opening 31.

More in detail, in addition to the first tab 50 and the second tab 51, each occluding element 5 also includes a third tab 52 which is articulated to the second end of the second tab 51 and which is fixed (with glue) to the wrapper 4.

This second embodiment of the package 1 also comprises a singulating element 6 disposed upstream of the occluding element 5 with respect to the bottom wall 30 of the container 3 to define a chamber 7 (FIGS. 9B-10B and 9C-10C) between the singulating element 6 and the occluding element 5.

The singulating element 6 is mobile between an open configuration C (FIGS. 6, 9C, 10C), where it allows an article 2 to enter the chamber 7 with the occluding element 5 in the closed configuration A, and a closed configuration D (FIGS. 4, 9A, 10A and 7, 9E, 10E), where it prevents an article 2 from entering the chamber 7 with the occluding element 5 in the open configuration B.

The singulating element 6 is fixed to the container 3 and to the wrapper 4 so that the reciprocal sliding of the wrapper 4 and the container 3 causes the singulating element 6 to move between the open configuration C and the closed configuration D.

Thus, when the singulating element 6 is in the open configuration C, the occluding element 5 is in the related closed configuration A (FIGS. 9C, 10C) and when the singulating element 6 is in the closed configuration D, the occluding element 5 is in the related open configuration B (FIGS. 9A, 10A, 9E, 10E).

Advantageously, only a certain number of articles 2 (determined by the number of articles 2 which the chamber 7 can hold) can come out of the container 3 during an operating cycle of the package 1. In other words, the proposed package 1 is a dispensing package 1 of the type which can control the number of articles 2 dispensed in each cycle, depending on the size of the chamber 7.

With the package 1 therefore it is possible to prevent an unwanted number of articles 2 to come out of the container 3.

Preferably, the singulating element 6 and the occluding element 5 are mutually positioned in such a way that the chamber 7 is sized to contain only one article 2.

Advantageously, this package 1 allows dispensing from the container 3 only one article 2 in each operating cycle of the package 1.

It is understood that in an embodiment not illustrated, the package 1 might comprise the singulating element 6 and only one occluding element 5.

Figure 10A:
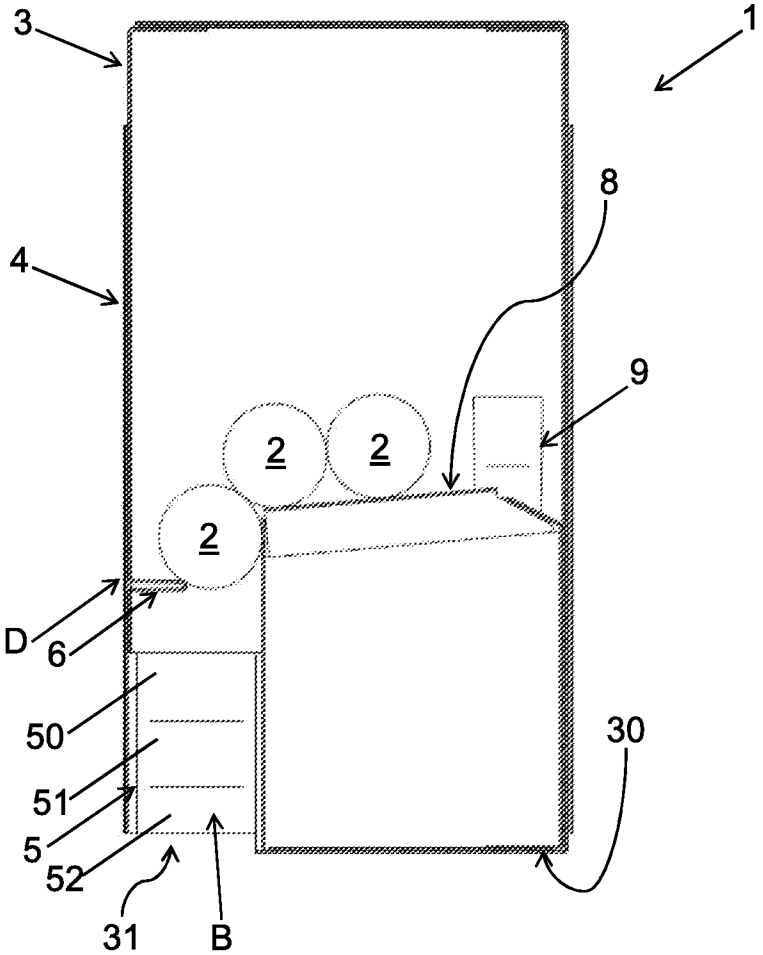
FIGS. 9A and 10A are cross section views along sections IV-IV and V-V of the package of FIG. 4 and FIG. 5, respectively.
Figure 9A:
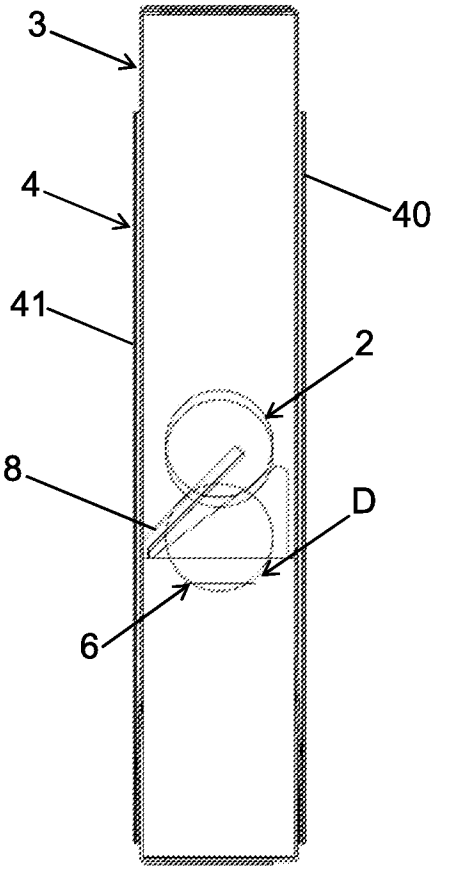
Figure 10B:
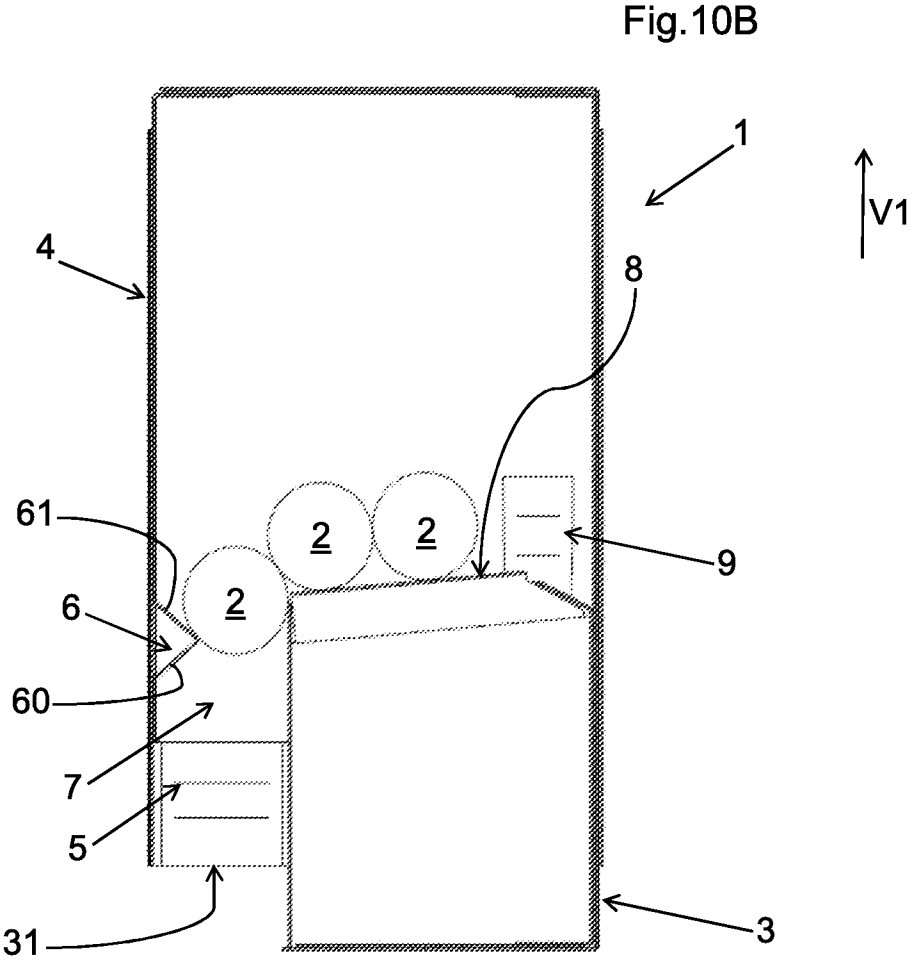
FIGS. 10B-10E are cross section views corresponding to the view of FIG. 10A, with the package in different operating steps.
Figure 9B:
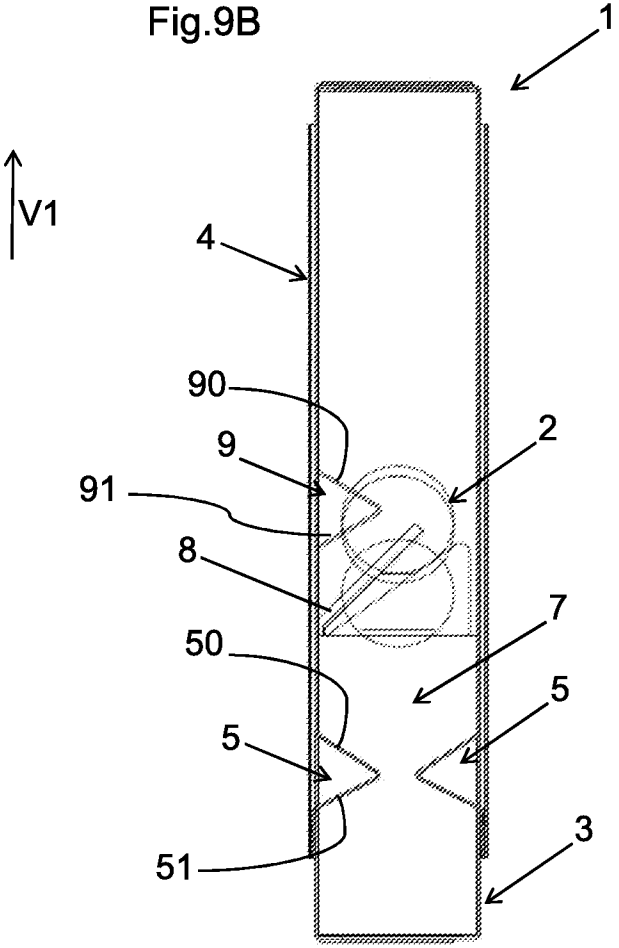
FIGS. 9B-9E are cross section views corresponding to the view of FIG. 9A, with the package in different operating steps.
Figure 10C:
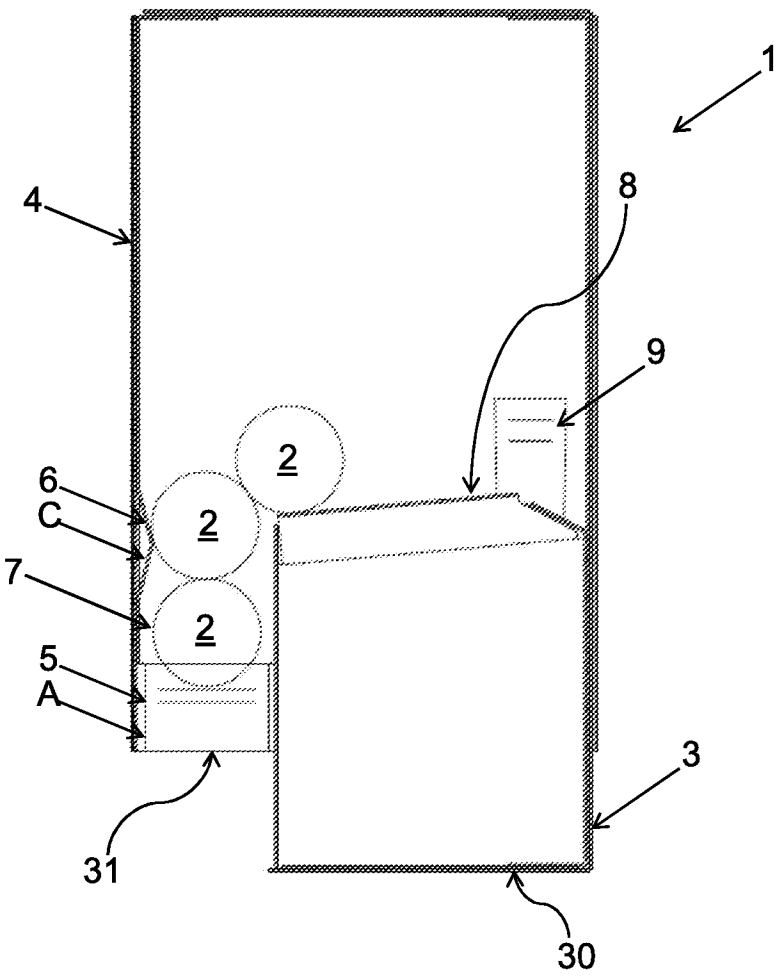
Figure 9C:
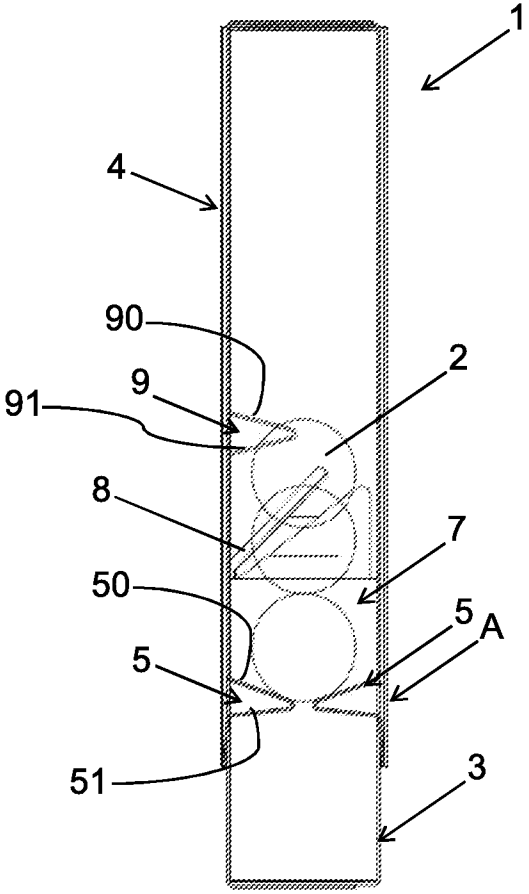
Figure 10D:
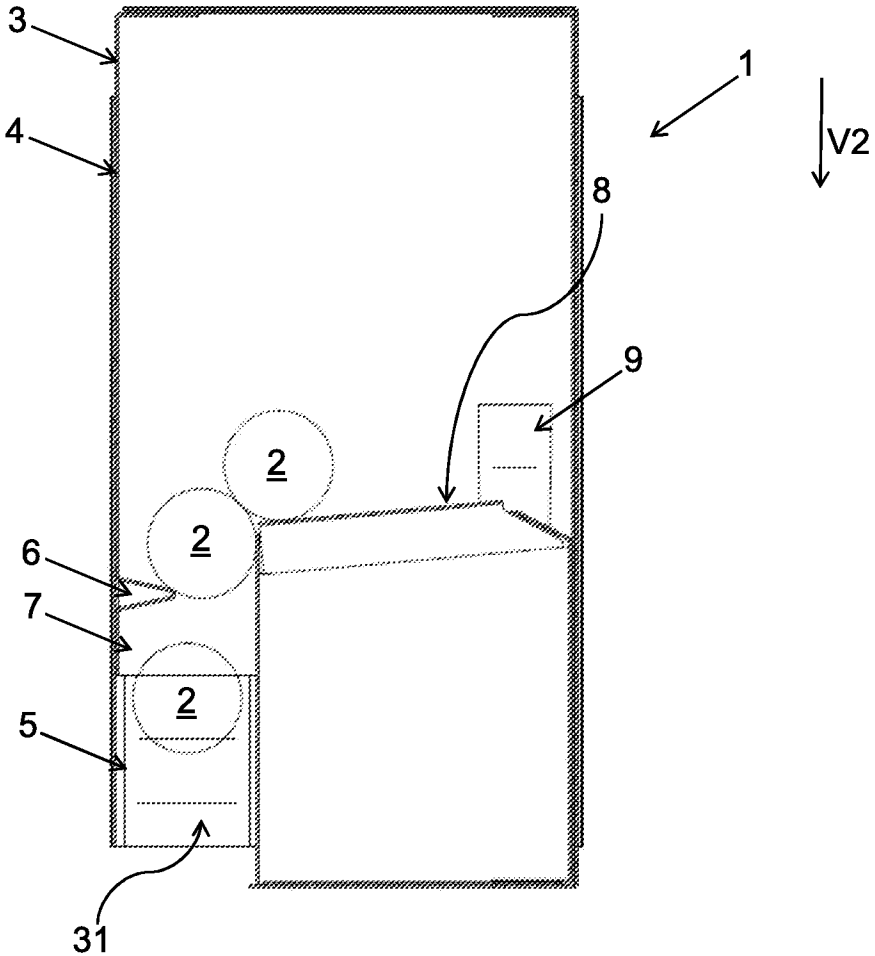
Figure 9D:
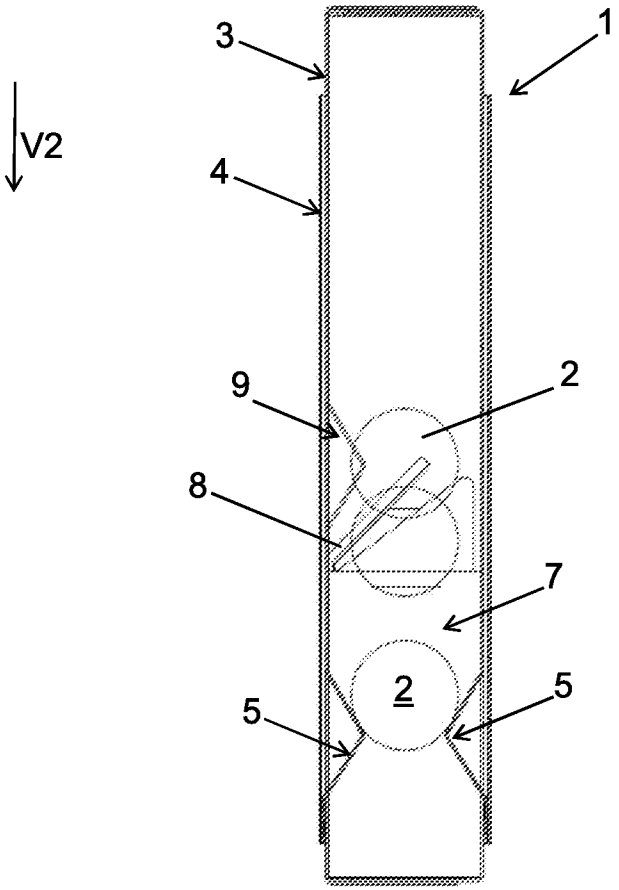
Figure 10E:
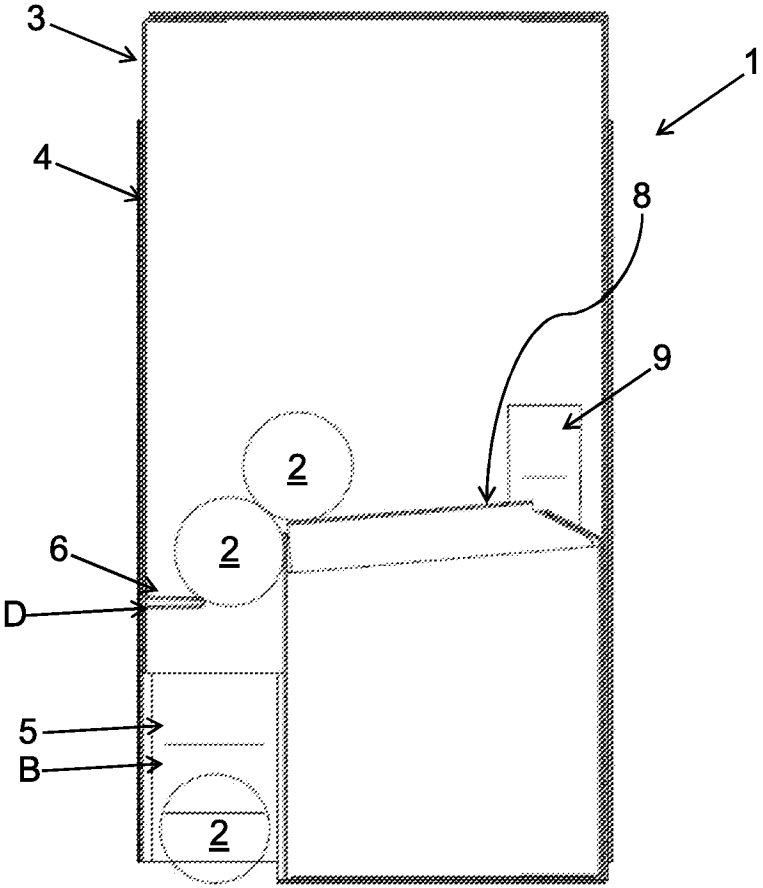
Figure 9E:
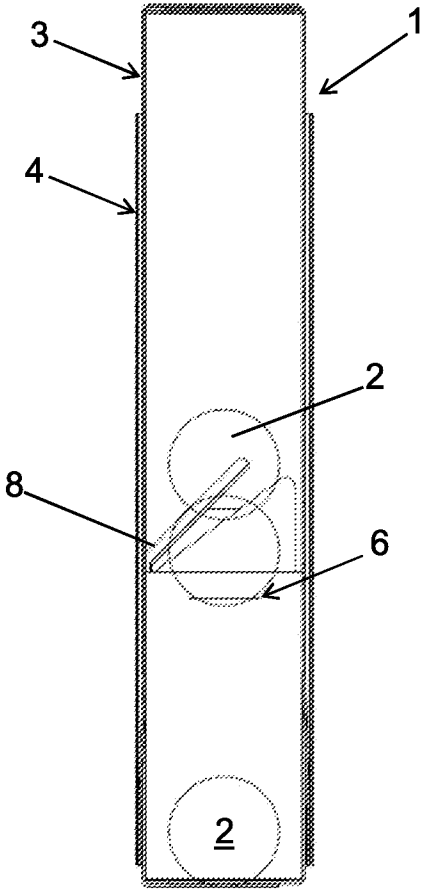

The singulating element 6 comprises: a first tab 60 having a first end fixed to the container 3 and a second end; a second tab 61 having a first end hinged to the second end of the first tab 60 and a second end fixed to the wrapper 4 (FIG. 10B).

Advantageously, this structure makes it easy for the singulating element 6 to move between the closed configuration D and the open configuration C.

In particular, when the singulating element 6 is in the closed configuration D, the first tab 60 and the second tab 61 face each other to form an element whose transverse cross section is substantially triangular and which protrudes towards the inside of the container 3 (FIG. 10A). On the other hand, when the singulating element 6 is in the open configuration C, the first tab 60 and the second tab 60 are substantially aligned (aligned vertically, that is, substantially parallel to the sliding direction X, FIG. 10C).

Preferably, the singulating element 6 is fixed to the first flank 34 of the container 3 and to the first flank 42 of the wrapper 4.

More in detail, in addition to the first tab 60 and the second tab 61, the singulating element 6 also includes a third tab 62 which is articulated to the second end of the second tab 61 and which is fixed (with glue) to the wrapper 4.

In the embodiment illustrated, the singulating element 6 is made as a single part with the container 3 and is fixed to the wrapper 4 by gluing. It is understood that it might also be made as a single part with the wrapper 4 and be fixed to the container 3. As a further alternative, the singulating element 6 might be made as a separate element and be fixed (for example by gluing) to the container 3 and to the wrapper 4.

As in the first embodiment of the package 1 described above with reference to FIGS. 1 and 2, in the embodiment of the package 1 illustrated in FIGS. 4-12, the package 1 also comprises a conveying plane 8 for conveying the articles 2, which is disposed inside the container 3 and which is inclined to the bottom wall 30 of the container 3 to facilitate conveying the articles 2 towards the outlet opening 31 of the container 3.

Advantageously, the conveying plane 8 allows the articles 2 to be fed continuously towards the outlet opening 31.

More in detail, the conveying plane 8 is disposed upstream of the chamber 7 with respect to the bottom wall 30 of the container 3.

The package 1 may also comprise an agitator element 9 that is disposed in proximity to the conveying plane 8 and is fixed to the container 3 and to the wrapper 4 so that the reciprocal sliding of the wrapper 4 and the container 3 causes the agitator element 9 to move in such a way as to facilitate conveying the articles 2 along the conveying plane 8.

Advantageously, the agitator element 9 prevents the articles 2 from mutually blocking each other inside the container 3.

The agitator element 9, as illustrated, comprises: a first tab 90 having a first end fixed to the container 3 and a second end; a second tab 91 having a first end hinged to the second end of the first tab 90 and a second end fixed to the wrapper 4. Advantageously, this structure makes it easy for the agitator element 9 to move.

As illustrated, the agitator element 9 is fixed to the second lateral wall 33 of the container 3 and to the second wall 41 of the wrapper 4. It might, however, also be fixed to the first lateral wall 32 of the container 3 and to the first wall 40 of the wrapper 4. Alternatively, it might be fixed to the second flank 35 of the container 3 and to the second flank 43 of the wrapper 4.

More specifically, in addition to the first tab 90 and the second tab 91, the agitator element 9 also includes a third tab 92 which is articulated to the second end of the second tab 91 and which is fixed (with glue) to the wrapper 4.

In the embodiment illustrated, the agitator element 9 is made as a single part with the container 3 and is fixed to the wrapper 4 by gluing. It is understood that it might also be made as a single part with the wrapper 4 and be fixed to the container 3. As a further alternative, the agitator element 9 might be made as a separate element and be fixed (for example by gluing) to the container 3 and to the wrapper 4.

With reference to the accompanying drawings, the wrapper 4 and the container 3 are reciprocally movable along the sliding direction X in a first direction V1 (FIGS. 4-6, 9A-9C and 10A-10C), in which the wrapper 4 and the bottom wall 30 of the container 3 move apart, and in a second direction V2 (FIGS. 6-7, 9D-9E and 10D-10E) opposite to the first direction V1.

Each occluding element 5 is disposed and shaped to be moved from the closed configuration A to the open configuration B when the wrapper 4 and the container 3 are moved in the second direction V2 and vice versa. The singulating element 6 is disposed and shaped to be moved from the closed configuration D to the open configuration C when the wrapper 4 and the container 3 are moved in the first direction V1 and vice versa.

Described below with reference to FIGS. 4-8, 9A-9E and 10A-10E is an operating cycle of the package 1 of this invention (that is, a cycle in which an article 2 is dispensed).

FIGS. 4, 5, 9A and 10A illustrate the package 1 at the initial position; at that position, the pair of occluding elements 5 are in the open configuration and the singulating element 6 is in the closed configuration D. After that, the wrapper 4 is made to slide relative to the container 3 in the first direction V1 (FIGS. 9B and 10B) until bringing the singulating element 6 to the open configuration C and the pair of occluding elements 5 to the closed configuration A (FIGS. 6, 9C, 10C): thus, one article 2 will be housed in the chamber 7. Next, the wrapper 4 is made to slide relative to the container 3 in the second direction V2 (FIGS. 9D and 10D) until bringing the pair of occluding elements 5 to the open configuration B and the singulating element 6 to the closed configuration D (FIGS. 7, 9E, 10E): the article 2 is thus dispensed from the chamber 7.

Figure 11:
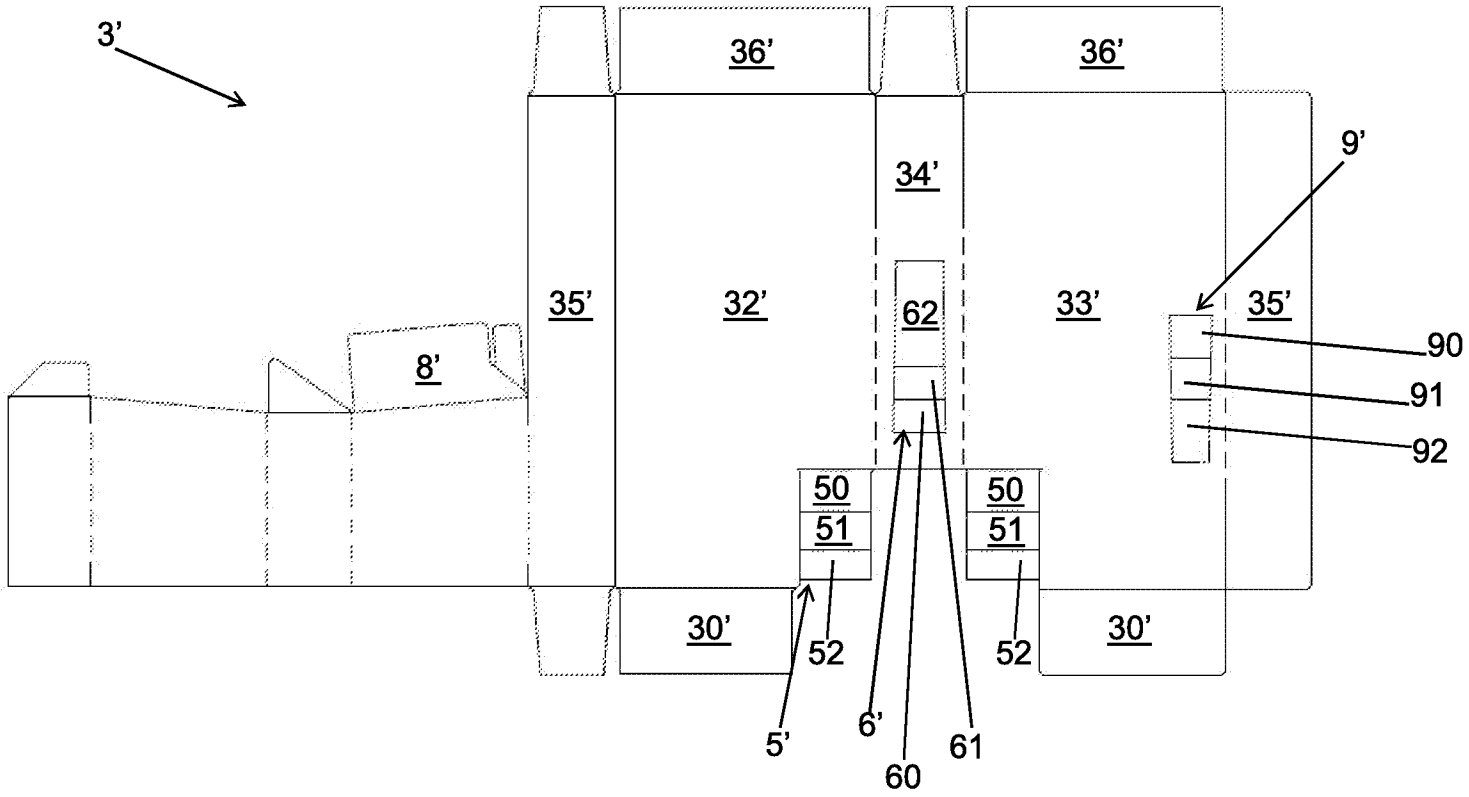
FIGS. 11 and 12 are plan views of a blank used to make the container and the wrapper of the package of FIG. 4, respectively.
Figure 12:
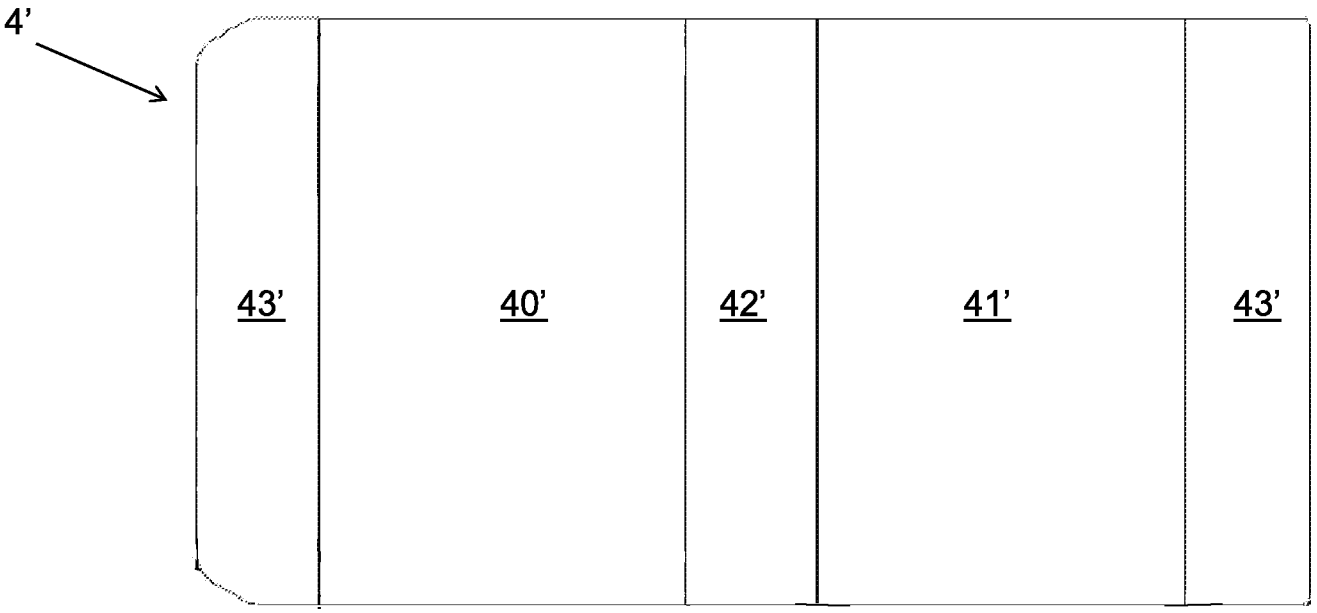

FIGS. 11 and 12 respectively illustrate the blank 3' from which the container 3 is made and the blank 4' from which the wrapper 4 is made. In FIGS. 11 and 12, the parts of the blank 3' and of the blank 4' are denoted, where possible, with primed reference numerals which are the same as the reference numeral that denote the corresponding parts of the container 3 and of the wrapper 4, respectively.

With reference to FIG. 11, it is evident that the blank 3' is also used to make the pair of occluding elements 5, the singulating element 6, the conveying plane 8 and the agitator element 9 as one with the container 3.

In order to make the package 1 according to a preferred embodiment, the blank 3' is first erected and pre-glued to form a self-supporting structure provided with the conveying plane. Next, the blank 4' is glued to the preassembled blank 3' to form the wrapper 4. More in detail, the blank 4' is glued at each occluding element 5 and at the singulating element 6, which are obtained from the blank 3. In further detail, the blank 4' is glued at the third tab 52 of each occluding element 5 and at the third tab 62 of the singulating element 6.

The invention claimed is:

1. A slide-open dispenser package for loose articles, comprising:

a container for containing a plurality of loose articles, where the container comprises a bottom wall and an outlet opening for dispensing the articles from the container;

a wrapper disposed externally of the container;

the wrapper and the container being slidably coupled to each other and reciprocally movable along a sliding direction orthogonal to the bottom wall of the container;

the outlet opening being made in the bottom wall;

an occluding element configured for occluding the outlet opening, in which the occluding element is mobile between a closed configuration, in which the occluding element prevents the articles from coming out through the outlet opening, and an open configuration, in which the occluding element allows at least one of the articles to come out through the outlet opening;

the occluding element being fixed to the container and to the wrapper so that the reciprocal sliding of the wrapper and the container causes the occluding element to move between the closed configuration and the open configuration;

wherein the occluding element comprises: a first tab having a first end fixed to the container and a second end; a second tab having a first end hinged to the second end of the first tab and a second end fixed to the wrapper.

2. The package according to claim 1, comprising:

a singulating element disposed upstream of the occluding element with respect to the bottom wall of the container to define a chamber between the singulating element and the occluding element;

the singulating element being mobile between an open configuration, where the singulating element allows one of the articles to enter the chamber with the occluding element in the closed configuration, and a closed configuration, where the singulating element prevents any of the articles from entering the chamber with the occluding element in the open configuration;

the singulating element being fixed to the container and the wrapper so that the reciprocal sliding of the wrapper and the container causes the singulating element to move between the open configuration and the closed configuration.

3. The package according to claim 2, wherein the singulating element comprises: a first tab having a first end fixed to the container and a second end; a second tab having a first end hinged to the second end of the first tab and a second end fixed to the wrapper.

4. The package according to claim 2, wherein the singulating element and the occluding element are mutually positioned in such a way that the chamber is sized to contain only one of the articles.

5. The package according to claim 1, comprising a conveying plane for conveying the articles, which is disposed inside the container and which is inclined to the bottom wall of the container to facilitate conveying the articles towards the outlet opening of the container.

6. The package according to claim 5, wherein the conveying plane is disposed upstream of the chamber with respect to the bottom wall of the container.

7. The package according to claim 5, and further comprising an agitator element that is disposed in a proximity of the conveying plane and is fixed to the container and to the wrapper so that the reciprocal sliding of the wrapper and the container causes the agitator element to move in such a way as to facilitate conveying the articles along the conveying plane.

8. The package according to claim 2, wherein:

the wrapper and the container are reciprocally movable along the sliding direction in a first direction, in which the wrapper and the bottom wall of the container move apart, and in a second direction opposite to the first direction;

the occluding element is disposed and shaped to be moved from the closed configuration to the open configuration when the wrapper and the container are moved in the second direction and to be moved from the open configuration to the closed configuration when the wrapper and the container are moved in the first direction;

the singulating element is disposed and shaped to be moved from the closed configuration to the open configuration when the wrapper and the container are moved in the first direction and to be moved from the open configuration to the closed configuration when the wrapper and the container are moved in the second direction.

9. The package according to claim 1, wherein the container comprises a first lateral wall and a second lateral wall which extend upwards from the bottom wall and which are opposed and parallel to each other; the package comprising a pair of the occluding element which are disposed opposite to each other and are fixed one to the first lateral wall and one to the second lateral wall of the container.

10. The package according to claim 1, wherein the occluding element is made as a single part with the container and the occluding element is fixed to the wrapper by gluing.

11. The package according to claim 1, wherein the occluding element is made as a single part with the wrapper and the occluding element is fixed to the container.

12. The package according to claim 1, wherein the occluding element is made as a separate element from the container and the wrapper and the occluding element is fixed to the container and to the wrapper.

13. The package according to claim 1, wherein the occluding element deforms between the closed configuration and the open configuration.

14. The package according to claim 13, wherein the deformation occurs along a direction at least partially parallel to the bottom wall.

15. The package according to claim 1, wherein, when the occluding element is in the closed configuration, the first tab and the second tab face each other to form an element having a triangular transverse cross section, the element protruding towards an interior of the container.

16. A slide-open dispenser package for loose articles, comprising:

a container for containing a plurality of loose articles, where the container comprises a bottom wall and an outlet opening for dispensing the articles from the container;

a wrapper disposed externally of the container;

the wrapper and the container being slidably coupled to each other and reciprocally movable along a sliding direction orthogonal to the bottom wall of the container;

the outlet opening being made in the bottom wall;

an occluding element configured for occluding the outlet opening, in which the occluding element is mobile between a closed configuration, in which the occluding element prevents the articles from coming out through the outlet opening, and an open configuration, in which the occluding element allows at least one of the articles to come out through the outlet opening;

the occluding element being fixed to the container and to the wrapper so that the reciprocal sliding of the wrapper and the container causes the occluding element to move between the closed configuration and the open configuration;

wherein the occluding element is made as a single part with the container and the occluding element is fixed to the wrapper by gluing.

17. A slide-open dispenser package for loose articles, comprising:

a container for containing a plurality of loose articles, where the container comprises a bottom wall and an outlet opening for dispensing the articles from the container;

a wrapper disposed externally of the container;

the wrapper and the container being slidably coupled to each other and reciprocally movable along a sliding direction orthogonal to the bottom wall of the container;

the outlet opening being made in the bottom wall;

an occluding element configured for occluding the outlet opening, in which the occluding element is mobile between a closed configuration, in which the occluding element prevents the articles from coming out through the outlet opening, and an open configuration, in which the occluding element allows at least one of the articles to come out through the outlet opening;

the occluding element being fixed to the container and to the wrapper so that the reciprocal sliding of the wrapper and the container causes the occluding element to move between the closed configuration and the open configuration;

a singulating element disposed upstream of the occluding element with respect to the bottom wall of the container to define a chamber between the singulating element and the occluding element;

the singulating element being mobile between an open configuration, where the singulating element allows one of the articles to enter the chamber with the occluding element in the closed configuration, and a closed configuration, where the singulating element prevents any of the articles from entering the chamber with the occluding element in the open configuration;

the singulating element being fixed to the container and the wrapper so that the reciprocal sliding of the wrapper and the container causes the singulating element to move between the open configuration and the closed configuration;

wherein the singulating element comprises: a first tab having a first end fixed to the container and a second end; a second tab having a first end hinged to the second end of the first tab and a second end fixed to the wrapper.

* * * * *